United States Patent [19]

Saito et al.

[11] Patent Number: 4,984,672

[45] Date of Patent: Jan. 15, 1991

[54] TREAD MEMBER FOR ESCALATOR OR TRAVELLING ROAD

[75] Inventors: Cyuichi Saito; Akio Ishida, both of Katsuta; Tatsuya Kaneko, Yokohama; Toshihiko Kimura, Mito, all of Japan

[73] Assignee: Hitachi, Ltd., Tokyo, Japan

[21] Appl. No.: 409,168

[22] Filed: Sep. 19, 1989

[30] Foreign Application Priority Data

Sep. 20, 1988 [JP] Japan ..... 63-233429

[51] Int. Cl.[5] ..... B66B 23/12

[52] U.S. Cl. ..... 198/333

[58] Field of Search ..... 198/333

[56] References Cited

U.S. PATENT DOCUMENTS

| | | | |
|---|---|---|---|
| 3,986,595 | 10/1976 | Asano et al. | 198/333 |
| 4,362,232 | 12/1982 | Saito et al. | 198/333 |
| 4,397,383 | 8/1983 | James | 198/333 |
| 4,519,490 | 5/1985 | White | 198/333 |
| 4,570,781 | 2/1986 | Kappenhasen | 198/333 |
| 4,858,745 | 8/1989 | Haas et al. | 198/333 |

FOREIGN PATENT DOCUMENTS

| | | | |
|---|---|---|---|
| 1144508 | 4/1983 | Canada | 198/333 |
| 0297233 | 1/1989 | European Pat. Off. | 198/333 |
| 0018685 | 2/1977 | Japan | 198/333 |
| 0041381 | 3/1977 | Japan | 198/333 |
| 0061083 | 5/1977 | Japan | 198/333 |
| 67068 | 6/1980 | Japan . | |
| 1276922 | 6/1972 | United Kingdom | 198/333 |

*Primary Examiner*—Robert P. Olszewski
*Assistant Examiner*—James R. Bidwell
*Attorney, Agent, or Firm*—Fay, Sharpe, Beall, Fagan, Minnich & McKee

[57] ABSTRACT

A passenger conveyance tread member, which may be for an escalator or a travelling road, has a tread surface with lateral edges having surfaces which slope towards skirt guards adjacent the lateral edges. The sloping surfaces and skirt guards define a downwardly narrowing gap so that the tendency of e.g. shoes to get seriously stuck in the gap is reduced. The sloping surface may be on a side-most cleat of the tread. An existing conveyance may be adapted by providing its tread members with such sloping surfaces at their edges, e.g. as an insert strip.

37 Claims, 5 Drawing Sheets

TREAD MEMBER FOR ESCALATOR OR TRAVELLING ROAD

BACKGROUND OF THE INVENTION

1. Field of the Invention

This invention relates to tread members for passenger conveyance apparatus, in particular steps of escalators and pallets of travelling roads, of the type where in operation the lateral edge of the moving tread surface is closely spaced from a stationary skirt guard. The invention also provides insert strips for such tread members, passenger conveyance apparatus having such tread members and a method of adaptation of such apparatus.

2. Description of the Prior Art

In general, the step of an escalator comprises a step surface that has many cleats extending in the travel direction of the step and providing the tread surface, and a riser that extends downwardly from the front edge of the tread surface. The steps are endlessly coupled together and are circulated around a continuous path, and both side edges of the step surface and the riser are opposed, across a gap, to a skirt guard that covers the side portion of the inner lower portion of a balustrade that supports the handrail. See for example Japanese Utility Model Laid-Open No. 67068/1980. Pallets of travelling roads are similar, except that they do not have risers.

When an escalator having such steps is in operation, relative motion occurs between the steps and the skirt guard. When a passenger standing on the step brings part of his footwear in contact with the skirt guard, the footwear may be caught in the gap between the step and the skirt guard. Such an accident may develop in the gap between the tread surface of the step and the skirt guard when the escalator is in rising operation, i.e. when the steps are upwardly moving, and develops in the gap between the riser of the step and the skirt guard when the escalator is in descending operation.

In order to prevent shoes or the like from being caught in the gap between the step and the skirt guard, the steps have been provided with caution members which indicate the safe range for the feet on the steps, so that footwear will not be brought into contact with the skirt guard. This, however, is simply a warning which is far from a concrete measure to avoid or reduce the problem. Such a caution member may be an insert strip.

SUMMARY OF THE INVENTION

The object of the present invention is to provide tread members for a passenger conveyance apparatus capable of reducing the risk of the occurrence of the accident that the footwear of a passenger is caught in the gap between the step and the skirt guard.

In a first aspect, the invention consists in a member providing a tread surface, for a passenger conveyance, which member is one of an escalator step and a pallet of a travelling road. The tread surface has opposite lateral edges which in use of the member are closely spaced from skirt guards of the apparatus. At at least one of said lateral edges, the member has a sloping surface extending downwardly and outwardly from the tread surface, the sloping surface thus in use being slopingly opposed to the skirt guard.

As is explained more below, it has been found that this sloping surface is beneficial in avoiding trapping of a shoe in the gap and helping the passenger to remove his shoe from the skirt guard.

In principle, the invention provides improved safety by the sloping surface on the tread member such that during operation of the apparatus an elastomeric body entering said gap is subjected by said sloping surface and the skirt guard to horizontal forces tending to move the body away from the skirt guard.

Where the tread member has a plurality of upstanding cleats extending in the travel direction of the member parallel to said lateral edges, said cleats having top surfaces which provide said tread surface of the member, the sloping surface is on a side-most one of said cleats and extends downwardly and outwardly from the top surface thereof.

Preferably in the direction perpendicular to the travel direction the horizontal extent of the sloping surface is less than half the width of the top of said side-most cleat. The vertical extent of said sloping surface is less than the height of the cleat, preferably less than half the height of the cleat, more preferably less than 30% of the height of the cleat Preferably the remaining top surface of the cleat is at least 1 mm in width.

The sloping surface is preferably a planar inclined surface, in which case the angle of inclination of the sloping surface, relative to the horizontal direction perpendicular to the travel direction, is preferably in the range 30° to 60°, more preferably 35° to 55°. In the direction perpendicular to the travel direction, the horizontal extent of the sloping surface is preferably in the range 1.5–3.5 mm.

It has been found significantly to reduce further the risk of trapping of a shoe in the gap if the sloping surface does not extend the whole length of the lateral edge, and there is at least one short tread surface portion upstanding from the sloping surface and adjacent thereto along the lateral edge. This short tread surface portion preferably has a length in the tread direction in the range of 4 to 7 mm.

The sloping surface may be on an insert piece providing a lateral portion of the tread surface and secured in place on the tread member. This insert piece may be differently coloured from the major part of the tread surface and thus act as a caution member.

The invention may also be applied to a riser of an escalator step extending downwardly from a front edge of the tread surface. The riser has a front surface extending across the step parallel to the front edge of the step and has, at at least one of its lateral edges, a sloping surface extending outwardly and rearwardly from said front surface so as in use to define, together with an adjacent vertical skirt guard, a rearwardly narrowing gap. The sloping surface here has the same function as at the edge of the tread surface. Preferably the sloping surface of the riser has a width in the lateral direction of less than 3.5 mm.

The invention also provides passenger conveyance apparatus having a plurality of moving tread members, means for moving said tread members in a continuous path having upper and lower runs and a pair of opposed skirt guards arranged adjacent said upper run so that the tread members move between them. Each said tread member has, at at least one of its lateral edges, a sloping surface as described above.

The skirt guards may have projections extending parallel to the direction of travel of the tread members in the upper run and overhanging said sloping surfaces. This provides additional protection, warning the passenger to keep his feet away from the skirt guard. The skirt guards may have low-friction coatings adjacent the tread members in the upper run.

The invention further provides an insert strip for a tread member of a passenger conveyance apparatus. The insert strip has at least two upstanding cleats and a base portion connecting said cleats. The cleats having top surfaces which, when the strip is mounted, provide part of the tread surface of the tread member. One cleat at the lateral edge of the insert strip has the sloping surface extending downwardly and outwardly from its top surface.

The invention also provides a method of adaptation of a passenger conveyance apparatus comprising adapting tread members of the apparatus so as to provide them at their extreme lateral edges with sloping surfaces as described above.

This method may consist in providing the tread members with insert strips as described above.

The invention can provide escalator or travelling road tread members having at their lateral edges sloping surfaces providing, with the opposed skirt guards, spaces of dimensions such that a passenger's shoe contacting the skirt guard and entering the space is not pulled downwardly.

In another aspect, the invention consists in a member providing a tread surface for a passenger conveyance, which member is one of an escalator step and a pallet of a travelling road, said tread surface having opposite lateral edges which in use of the member are closely spaced from skirt guards of the apparatus, and said member at at least one of said lateral edges having an upper surface region which is stepped in the direction along the lateral edge. The stepped upper surface region comprises at least one lower surface and at least one higher surface adjacent to said lower surface in said direction and shorter than said lower surface in said direction. This stepped edge surface region provides increased safety against trapping of footwear in the gap between the tread surface and the skirt guard, as explained more below.

Preferably the higher surface is less than onethird the length of the lower surface in the direction along the edge.

The upper surface preferably has a length in the direction along the edge in the range 4 to 7 mm, and the lower surface preferably has a length in said direction in the range 30 to 110 mm. The maximum height of the higher surface above the lower surface is in the range of 1.5 to 5 mm. The higher surface may be at the same level as the general level of the adjacent region of the tread surface. The lower surface is preferably an outwardly and downwardly sloping surface, as described above.

The stepped upper surface region preferably comprises a plurality of said higher surfaces alternating in the edge direction with a plurality of said lower surfaces.

In this aspect therefore, the invention provides narrow upper surface regions of the tread members adjacent the skirt guards of alternating height in the direction parallel to the skirt guards, each said upper surface region having in said direction at least one relatively short higher surface adjoining a relatively long lower surface.

The invention is especially applicable to tread members of plastics material or metal, in which the desired shape can be accurately formed.

BRIEF INTRODUCTION OF THE DRAWINGS

Embodiments of the invention will now be described by way of non-limitative example with reference to the accompanying drawings, in which.

DESCRIPTION OF THE PREFERRED EMBODIMENTS

Figure 1:
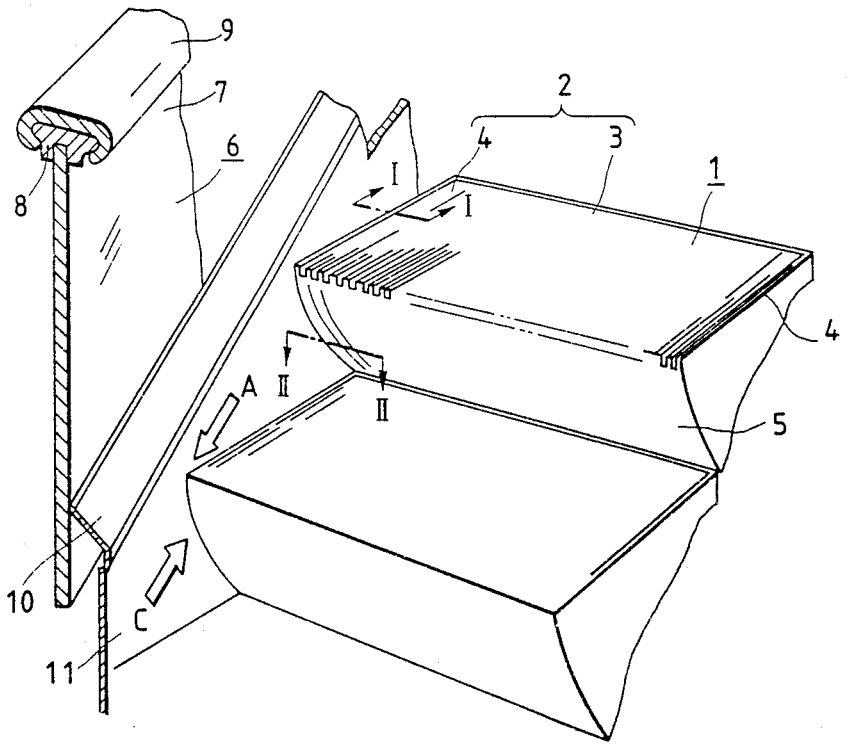
FIG. 1 is a partial perspective view of an escalator forming one embodiment of the present invention.

An escalator embodying the present invention is illustrated in FIGS. 1 to 5. Each step 1 of the escalator comprises a tread surface 2 on which the passengers stand, and a riser 5 that extends downwardly from the front edge of the tread surface 2 facing in the direction in which the escalator travels downwardly. The steps 1 are endlessly coupled together and are circulated around a continuous path in a conventional manner. The tread surface 2 of the step 1 is constituted by a main surface portion 3 which is made of aluminium alloy (as shown) or of thin stainless steel sheet and which has many upstanding cleats 3C extending in the travel direction, and a caution member 4 which is an insert made of a synthetic resin and has three cleats 4C extending in the travel direction. The caution members 4 are detachably mounted at the lateral edges of the main surface portion 3 and have a colour different from that of the main surface portion 3, e.g. are yellow to attract attention. The riser 5 extends downwardly from the front edge of the tread step surface 2, and has many ribs 5A extending in the direction parallel to its lateral edges. The riser 5 also is made of an aluminium alloy or a thin stainless steel plate.

On both sides of the set of steps 1 are erected handrails 6 over nearly the overall length of the escalator. The handrail 6 consists of a handrail panel 7 of which the lower portion is secured erect by a fastening member (not shown), a guide frame 8 mounted on the handrail panel 7, and a moving rail 9 which is guided by the guide frame 8 and moves in synchronism with the steps 1. The lower portion on the inside (step side) of the handrail 6 is covered by an inner deck 10 which has a downwardly extending wall which constitutes a skirt guard 11. The two lateral edges of the steps 1 are opposed to the skirt guards 11 and a gap g exists between them and the skirt guards 11. As described so far, the escalator is conventional, and further details need not be given.

Along the side-most cleats 4B of the caution member 4 and the side-most ribs or ridges 5B of the riser 5 of the step 1, sloping surfaces 4S and 5S are provided which are opposed to the skirt guard 11 and slope outwardly toward the skirt guard 11 from the tops 4T and 5T of the cleat or rib. The sloping surfaces 4S and 5S are straight surfaces (as seen in cross-section) and slope at a predetermined angle. The function of the sloping surfaces 4S,5S is to increase safety, in particular to reduce or avoid the risk that an elastomeric, e.g. vinyl, shoe 12 of a passenger is trapped in the gap g as will now be described.

A passenger on the tread surface 2 may bring the toe 12T of his vinyl shoe 12 in contact with the skirt guard 11 while the escalator is in ascending operation. In this case, the skirt guard 11 moves in the direction of arrow A in FIG. 1 relative to the step 1. Due to the friction relative to the skirt guard 11, therefore, the toe 12T of the vinyl shoe 12 enters into a V-shaped space defined by the sloping surface 4S and the skirt guard 11. In this space, the toe 12T is continuously pushed in the direction of arrow B. However, the sloping surface 4S is opposed to the direction of the arrow B and produces reaction R. The reaction R is thus opposed to the frictional force of the skirt guard 11 which moves the toe 12T so that slipping develops between the toe 12T and the skirt guard 11. Therefore, the toe 12T is not caught in the narrow gap g. That is, the toe 12T of the vinyl shoe 12 of the passenger stays on the sloping surface 4S.

If the passenger notices this abnormal condition and pulls his foot away, the shoe can be smoothly pulled out by simply pulling upwardly along the inclination $\theta$ of the sloping surface 4S without the need to pull upwardly along the skirt guard 11.

On the other hand, if there is no sloping surface 4S, the vinyl shoe 12 that has entered into the gap g even a little is gradually pulled deep into the gap g since there is no portion where the toe is stopped and no reaction is produced. Then, the passenger must pull his trapped shoe 12 upwardly along the skirt guard 11, which may be very troublesome.

Figure 5:
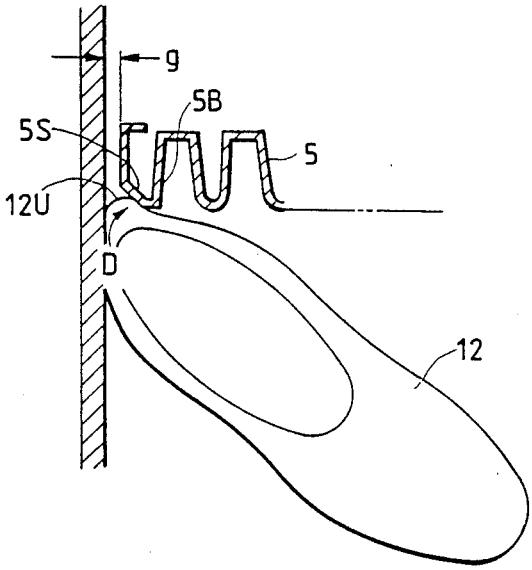
FIG. 5 is similarly a schematic view on an enlarged scale corresponding to FIG. 3 illustrating the effect of the invention.

Similarly, when a passenger brings the heel 12U of his vinyl shoe 12 in contact with the skirt guard 11 and the side portion of the riser 5 while the escalator is in descending operation, the skirt guard 11 moves in the direction of arrow C in FIG. 1 relative to the step 1. Therefore, the heel 12U of the vinyl shoe 12 enters into a V-shaped space defined by the sloping surface 5S of the ridge 5B and the skirt guard 11 as shown in FIG. 5 due to the frictional force of the skirt guard 11. In this space, the heel 12U of the vinyl shoe 12 is continuously pushed by the skirt guard 11 and is forced in the direction of arrow D. However, the sloping surface 5S opposes the direction of the arrow D and produces a reaction just like that of the sloping surface 4S of the cleat 4B mentioned above. Therefore, the heel 12U does not enter into the narrow ga g any further but stops on the sloping surface 5S, and can easily be withdrawn.

Thus vinyl shoes 12 that hitherto have easily been caught in the gap between the skirt guard 11 and the tread surface 2 when the escalator is in ascending operation or caught in the gap between the skirt guard 11 and the riser 5 when the escalator is in descending operation, are now prevented from being caught by the gap g by the provision of the sloping surfaces 4S and 5S at the edge portions of the cleat 4B and the ridge 5B opposed to the skirt guard 11. Therefore, the risk of an incident which may result in injury is much reduced.

Figure 4:
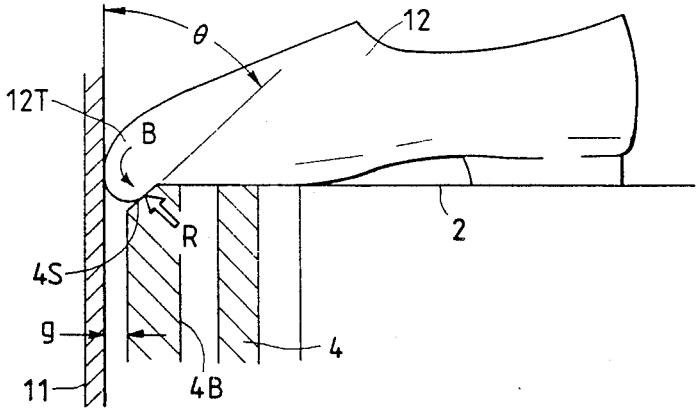
FIG. 4 is a schematic view on an enlarged scale similar to FIG. 2 illustrating the effect of the invention.

While the applicants do not wish to be bound by theory, a possible explanation of the operation of the sloping surfaces 4S,5S is as follows. As FIGS. 4 and 5 show, a portion of the shoe 12 comes into contact with the skirt guard 11 and the sloping surface 4S,5S and presses against both. Because the shoe is of elastomeric material, the forces applied by the shoe to the skirt guard and the sloping surface are equal. Therefore the reaction force applied by the skirt guard perpendicularly to the skirt guard surface is equal to the reaction force applied by the sloping surface perpendicularly to the sloping surface. Consequently the sum of these two reaction forces in the direction perpendicular to the skirt guard surface is a net force pushing the shoe away from the skirt guard. This net force thus tends to move the shoe along the sloping surface away from the skirt guard. According to this explanation, therefore, the presence of the sloping surface 4S,5S actually tends to help movement of the shoe away from the skirt guard. Depending on the coefficient of friction between the shoe and the skirt guard, it may be that the vertically upward component of the reaction force applied by the sloping surface balances the downward frictional force applied by the skirt guard, so that the shoe is not pulled downwardly.

In the embodiment so far described, the sloping surfaces 4S provided at both edges of the tread surface 2 of the step 1 are formed on the caution members 4 that are made separately from the tread surface 3. In an escalator step which does not have separately constituted caution members 4 but of which the tread surface 2 is entirely constituted by the tread surface 3 made of aluminium alloy, the sloping surfaces may be formed at the time of molding of the tread surface 3 or may be formed after the tread surface 3 is molded. At present, however, it is commonly accepted practice to mount the separately constituted caution members 4 at the time of assembling the escalator steps. Therefore, the sloping surfaces 4S can be easily formed by first molding the caution members 4 in advance, and then mounting the caution members on both sides of the tread surface when assembling the steps. In existing escalator equipment, the present caution members may simply be replaced by the caution members 4 of the present invention to put the present invention into practice.

Desirably the sloping surfaces 4S have surfaces as smooth as those of other portions of the caution member 4 such that the vinyl shoe 12 caught in the V-shaped space bounded by the skirt guard 11 and the sloping surface can be easily pulled out. This can be easily accomplished if the caution member 4 is composed as a unitary structure of a synthetic resin.

Figure 6:
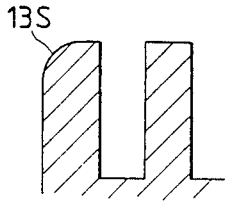
FIGS. 6 to 9 are vertical section views similar to FIG. 2 showing further embodiments of the invention applied to escalator steps.
Figure 7:
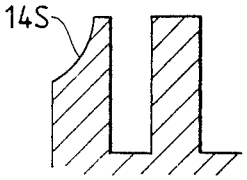

In the embodiment described above, sloping surfaces 4S and 5S which are linear in transverse cross-section are formed on the cleat 4B and the ridge 5B. The sloping surfaces, however, need not necessarily be linear but may be curved as illustrated by sloping surfaces 13S and 14S shown in FIG. 6 and 7. FIG. 6 shows a sloping surface 13S having a convex curve and FIG. 7 shows a sloping surface 14S having a concave curve, as seen in transverse section.

Figure 8:
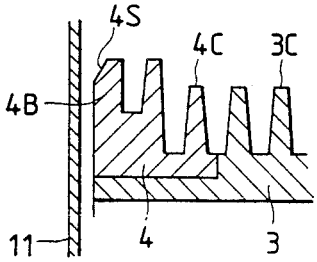
Figure 9:
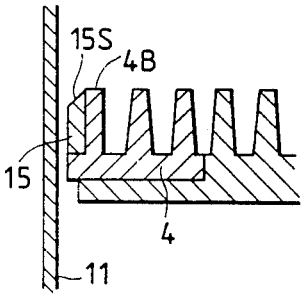

FIGS. 8 and 9 illustrate other examples in which sloping surfaces are formed in the tread surface 2 of the step 1 and opposed to the skirt guard 11. In FIG. 8, the sloping surfaces 4S are formed in the caution members 4 as in FIG. 2 but the difference is that the caution member 4 has a cleat 4C of the same height as the adjacent cleats 3C of the remainder of the tread surface 3 and further has two cleats 4B adjacent the lateral edge of greater height than the cleats 3C. The sloping surface 4S is formed on the cleat 4B opposed to the skirt guard 11. By this construction, the taller cleats 4B attract a passenger's attention when touched and, even if the shoe is caught, help to stop the shoe from being caught at the inlet of the gap g.

FIG. 9 illustrates an example in which a member 15 providing the sloping surface 15S is adhered onto the side of a cleat 4B of the caution member 4 opposed to the skirt guard 11. It is also possible that the top end of the sloping surface is slightly lower than the top surface of the cleat.

Figure 10:
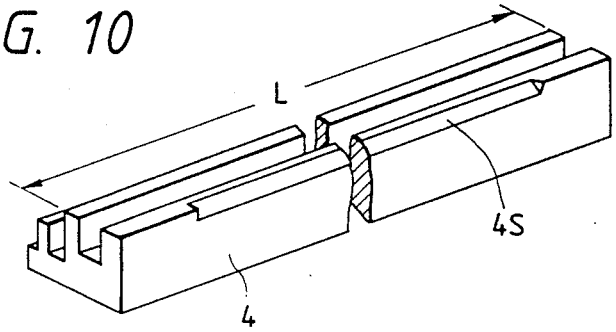
FIGS. 10 and 11 are perspective views of inserts for the treads of further escalator steps embodying the invention.

In the foregoing embodiments, the sloping surface 4S is formed in the caution member 4 continuously over the whole length of the step in the travel direction. As shown in FIG. 10, however, the sloping surface 4S may be continuously formed only in the middle portion of the length L in the travel direction, taking into consideration the fact that passengers stand on this middle portion. There are thus higher portions of tread surface adjacent each end of the sloping surface 4S in the travel direction.

Figure 11:
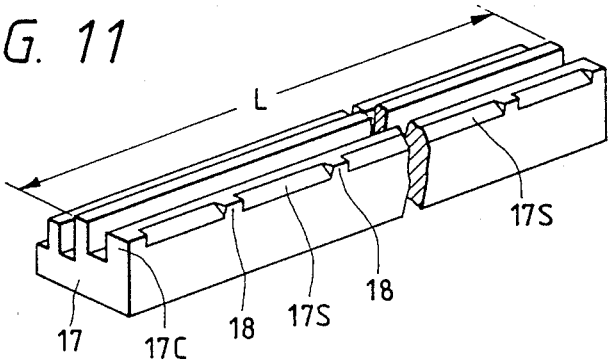

FIG. 11 illustrates another embodiment where sloping surfaces 17S are formed on a cleat 17C of a caution member 17. The sloping surfaces 17S are spaced over the length L in the travel, and higher portions 18 separate the sloping surfaces 17S.

Figure 12:
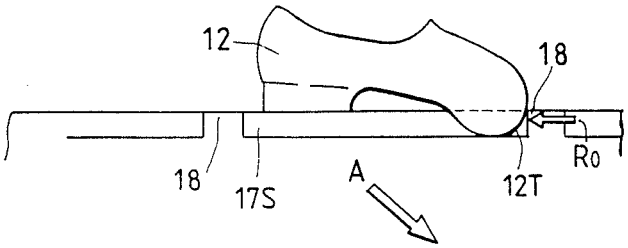
FIG. 12 is a schematic side view of an escalator step of the invention illustrating its operation.

Thus, there are higher surfaces (the tops of the higher portions 18) alternating with lower surfaces (the sloping surfaces 17S) in the travel direction. The effect of this is that, as illustrated in FIG. 12, even when the toe 12T of a vinyl shoe 12 stays on the sloping surface 17S due to the frictional force of the skirt guard (not shown) that acts in the direction of arrow A during the ascending of the escalator, the toe 12T is pushed rearwardly by the reaction $R_0$ produced by the higher portion 18, and the toe 12T is prevented from moving along the sloping surface 17S. If there is no higher portion 18, the toe 12T on the sloping surface 17S may move along the sloping surface due to the horizontal component of the frictional force in the direction of arrow A, causing the passenger to fall down.

Figure 13:
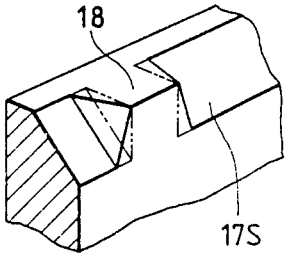
FIGS. 13 to 16 are perspective partial views illustrating embodiments of escalator steps having sloping surfaces and stepped portions.
Figure 14:
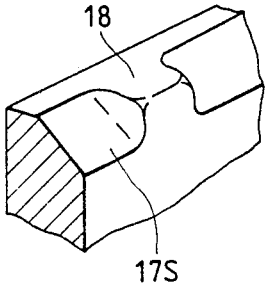

FIGS. 13 and 14 illustrate variations of the shapes of the higher portions 18 between the neighbouring sloping surfaces 17S. In FIG. 13, the higher portion 18 is joined to the adjacent sloping surfaces 17S by angled transitions sloping in the travel direction, rather than by vertical surfaces as indicated by the two-dot chain lines. FIG. 14 illustrates a higher portion 18 that is rounded.

Figure 15:
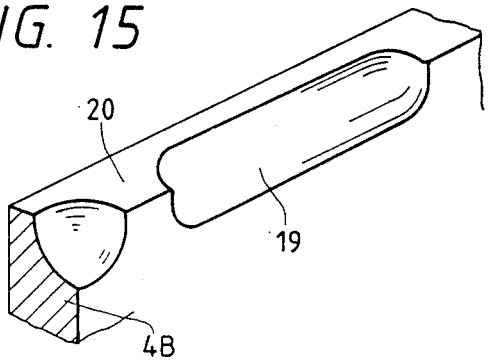

In FIG. 15, furthermore, the corner of the cleat 4B opposed to the skirt guard (not shown) is ground discretely to form sloping surfaces 19 and protuberances 20 alternatingly.

The sloping surfaces 17S, 19 are longer in the travel direction than the higher portions 18 and 20.

Figure 16:
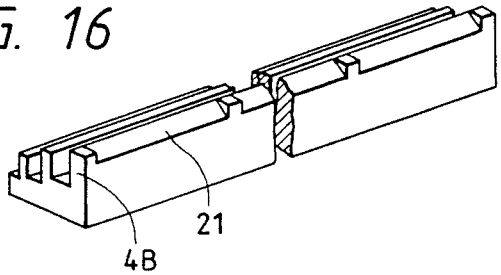

In FIG. 16 the sloping surfaces 21 are shown extending the whole width of the cleat 4B in contrast with the above-mentioned examples in which the sloping surfaces occupy only part of the width of the cleat.

Figure 17:
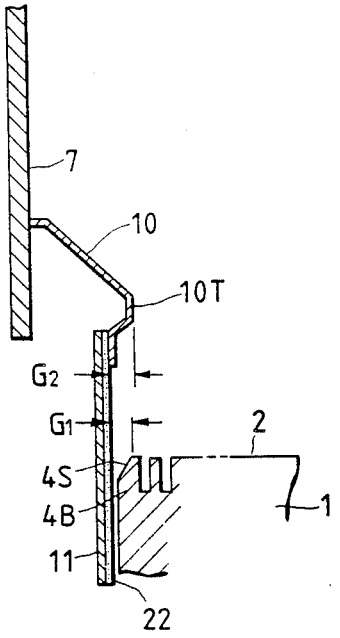
FIG. 17 is a vertical section view illustrating a portion of another escalator embodying the present invention.

In the foregoing embodiments, sloping surfaces were formed at both sides of the tread surface 2, or at both sides of the riser 5, to form a V-shaped space over the gap g between the step 1 and the skirt guard 11, such that the footwear of a passenger was not caught by the gap g. FIG. 17 illustrates another embodiment which is on the same principle and in which a cover 22 made of a low-friction member is provided on the surface of the skirt guard 11 t which the step 1 is opposed, such that the footwear of a passenger that happens to come into contact with the skirt guard 11 is less likely to be caught by the gap g due to the small frictional force. Even when caught, the footwear stays on the sloping surface 4S as explained above and is not pulled into the gap g, i.e. the footwear can be easily pulled out.

The low-friction member 22 may be, for example, a fluorine-containing resin which is mounted in the form of a thin plate on the skirt guard, or which is directly baked onto the skirt guard 11, or a member on which the fluorine-containing resin is mounted is mounted on the skirt guard 11, thereby to provide the cover 22.

Over the skirt guard 11 is further provided an inner deck 10 that covers the inner lower portion of the handrail panel 7. Part 10T of the inner deck 10 projects a distance $G_2$ greater than the gap G between the skirt guard 11 and the edge of the top of the cleat 4B at the top of the sloping surface 4S. Thus, part of the inner deck 10 overlaps the step surface 2 of the step 1. The projection lOT attracts a passenger's attention to the risk that footwear may come into contact with the skirt guard 11.

Figure 18:
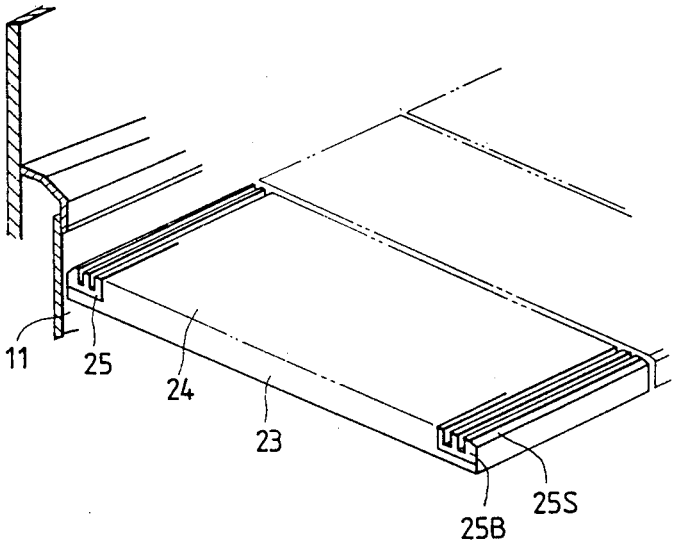
FIG. 18 is a perspective view showing a portion of an electrically driven travelling road embodying the present invention.

Though the foregoing description has all been concerned with the steps of escalators, the present invention can also be employed for the pallets or steps 23 of an electrically driven travelling road a shown in FIG. 18. The step 23 has a tread surface 24 formed of cleats. Caution members 25 are mounted at both side edges of the tread surface 24, and a sloping surface 25S is formed on the cleat 25B of the caution member 25 opposed to the skirt guard 11. The handrail is constituted in the same manner as that of FIG. 1.

One advantage of the invention, when the sloping surface is formed on a caution member that is to be mounted at an edge of the tread surface is that the sloping surface can be easily formed, and can be formed in advance when fabricating the steps. The caution members of passenger conveyors that are now in use can be easily replaced by the caution members of the present invention.

Experiments have been performed to assess the effect of the invention quantitatively. Three different escalator steps were used, as follows:

Step I: a conventional step with a tread surface of cleats, in which the side-most cleat is of rectangular sectional shape (i.e. no sloping surface)

Figure 2:
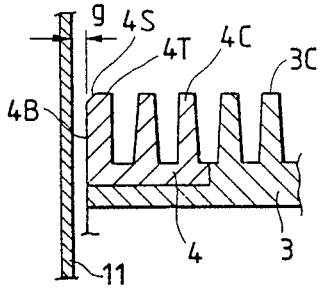
FIG. 2 is a vertical section view on an enlarged scale along the line I—I of FIG. 1.
Figure 3:
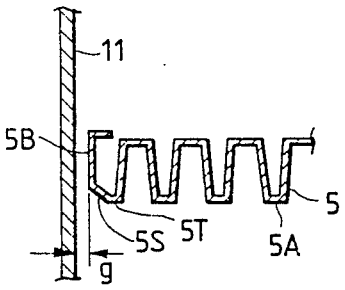
FIG. 3 is a transverse section view on an enlarged scale along the line II—II of FIG. 1.

Step II: a step embodying the invention, as shown in FIG. 2, in which the side-most cleat of the tread surface has a sloping surface at 45° to the vertical, and has 2 mm vertical extent and 2 mm horizontal extent. The sloping surface extends the full length of the step in the travel direction.

Step III: a step embodying the invention having an side-most cleat as shown in FIG. 11, wherein the sloping surfaces 17S are of dimensions as in step II and have a length of 40 mm in the travel direction and are separated by higher portions 18 of length 7 mm. The higher portions 18 join the sloping surfaces 17S by vertical transitions.

These three steps were mounted on a real escalator, in which the steps move at an angle of 30° to the horizontal. The skirt guard is of stainless steel and is vertical. As a test piece simulating a shoe, there was used a piece of rubber of Rockwell hardness 65, having the following dimensions:

thickness—10 mm
length—150 mm
width—50 mm
tapering in width at one end over 40 mm length from 50 mm to 25 mm and bevelled at this narrow end to give a bevelled end-face at 45°.

In the test this test piece was placed transversely across the escalator step, with its bevelled end-face upwards, and was urged by a measured force applied to it at 45° to the horizontal so that its narrow end is pushed against the skirt guard. The force is increased until the test piece becomes trapped in the gap between the skirt guard and the step. The width of this gap cannot be precisely specified, because a real escalator was used.

The horizontal components of the threshold forces for trapping of the test piece (average of four tests in each case) were:

Step—14 kg
Step II—6 kg
Step III—10.5 kg

This shows that significantly larger forces are required to cause trapping with the steps of the present invention, than with the conventional step.

While the preferred embodiment has been set forth along with modifications and variations to show specific advantageous details of the present invention, further embodiments, modifications and variations are contemplated within the broader aspects of the present invention, all as set forth by the spirit and scope of the following claims.

What is claimed is:

1. A member providing a tread surface, for a passenger conveyance apparatus, which member is one of an escalator step and a pallet of a travelling road, said tread surface having opposite lateral edges which in use of the member are closely spaced from skirt guards of the apparatus, said member at at least one of said lateral edges having a sloping surface extending inwardly and outwardly from the tread surface, said sloping surface thus in use being slopingly opposed to the skirt guard, a plurality of upstanding cleats extending in the travel direction of the member parallel to said lateral edges and including side-most cleats and intermediate cleats, each of aid cleats having top surfaces which provide said tread surface of the member, and said sloping surface being on a side-most one of said cleats and extending downwardly and outwardly from the top surface thereof at an angle relative to the skirt guards that is substantially larger than the corresponding angle of said intermediate cleats.

2. A member according to claim 1 wherein in the direction perpendicular to the travel direction the horizontal extent of said sloping surface is less than half the width of the top of said side-most cleat.

3. A member according to claim 1 wherein the vertical extent of said sloping surface is less than half the height of the cleat.

4. A member according to claim 1 wherein said sloping surface is a planar inclined surface.

5. A member according to claim 4 wherein the angle of inclination of said sloping surface, relative to the horizontal direction perpendicular to the travel direction, is in the range of 30° to 60°.

6. A member according to claim 1 wherein in the direction perpendicular to the travel direction the horizontal extent of said sloping surface is in the range 1.5–3.5 mm.

7. A member according to claim 1 wherein the tread surface has a raised portion adjacent said at least one lateral edge, which portion is above the general level of said tread surface.

8. A member according to claim 1 wherein said sloping surface is on an insert piece providing a lateral portion of the tread surface and secured in place on the member.

9. A member providing a tread surface, for a passenger conveyance apparatus, which member is one of an escalator step and a pallet of a travelling road, said tread surface having opposite lateral edges which in use of the member are closely spaced from skirt guards of the apparatus, and said member at at least one of said lateral edges having a sloping surface extending inwardly and outwardly from the tread surface, said sloping surface thus in use being slopingly opposed to the skirt guard, wherein said sloping surface does not extend the whole length of the lateral edge, there being at least one short tread surface portion upstanding from said sloping surface and adjacent thereto along the lateral edge.

10. A member according to claim 9 wherein said short tread surface portion has a length in the tread direction in the range of 4 to 7 mm.

11. An escalator step member, comprising:

a tread surface, said tread surface having opposite lateral edges which in use of the member are closely spaced from skirt guards of the apparatus, said member at at least one of said lateral edges having a sloping surface extending inwardly and outwardly from the tread surface, said sloping surface thus in use being slopingly opposed to the skirt guard, a riser extending downwardly from a front edge of said tread surface, said riser having a front surface extending across the step parallel to the front edge of the step and having, at at least one of its lateral edges, a sloping surface extending outwardly and rearwardly from said front surface so as in use to define, together with an adjacent vertical skirt guard, a rearwardly narrowing gap.

12. A member according to claim 11 wherein said sloping surface of said riser has a width in the lateral direction of less than 3.5 mm.

13. In a passenger conveyance tread member selected from escalator steps and travelling road pallets and having a tread surface, the improvement comprising a sloping surface extending downwardly and outwardly from each of the extreme lateral edges of said tread surface so as to define, together with a vertical skirt guard of the escalator or road adjacent said edge, a downwardly narrowing gap, a plurality of upstanding cleats extending in the travel direction of the member parallel to said lateral edges and including side-most cleats and intermediate cleats, each of said cleats having top surfaces which provide said tread surface of the member, and said sloping surface being on a side-most one of said cleats and extending downwardly and outwardly from the top surface thereof at an angle relative to the skirt guards that is substantially larger than the corresponding angle of said intermediate cleats.

14. Passenger conveyance apparatus having a plurality of moving tread members, means for moving said tread members in a continuous path having upper and lower runs and a pair of opposed skirt guards arranged adjacent said upper run so that the tread members move between them, each of said tread member having a tread surface having opposite lateral edges which in said upper run are adjacent said skirt guards and, at at least one of said lateral edges, a sloping surface extending downwardly and outwardly from the tread surface so as to be slopingly opposed to the adjacent skirt guard in the upper run, a plurality of upstanding cleats extending in the travel direction of the member parallel to said lateral edges and including side-most cleats and intermediate cleats, each of said cleats having top surface which provide said tread surface of the member, and said sloping surface being on a side-most one of said cleats and extending downwardly and outwardly from the top surface thereof at an angle relative to the skirt guards that is substantially larger than the corresponding angle of said intermediate cleats.

15. Passenger conveyance apparatus according to claim 14 wherein said skirt guards have projections extending parallel to the direction of travel of the tread members in said upper run and overhanging said sloping surface.

16. Passenger conveyance apparatus according to claim 15 wherein said skirt guards have low-friction coatings adjacent said tread members in the upper run.

17. In a passenger conveyance apparatus having a plurality of moving tread members which have respective tread surfaces and are moved in a continuous path to provide travelling stairway or road and stationary skirt guards adjacent the moving tread members where passengers stand on them, the improvement providing improved safety of a sloping surface on said tread member forming a continuously downwardly narrowing gap between the lateral edges of each said tread member and skirt guard adjacent thereto, such that during operation of the apparatus an elastomeric body entering said gap is subjected by said sloping surface and the skirt guard to horizontal forces tending to move the body away from the skirt guard, a plurality of upstanding cleats extending in the travel direction of the member parallel to said lateral edges and including side-most cleats and intermediate cleats, each of said cleats having top surfaces which provide said tread surface of the member, and said sloping surface being on a side-most one of said cleats and extending downwardly and outwardly from the top surface thereof at an angle relative to the skirt guards that is substantially larger than the corresponding angle of said intermediate cleats.

18. An insert strip for a tread member of a passenger conveyance apparatus selected from escalators and travelling roads, said insert strip having at least two upstanding cleats and a base portion connecting said cleats, said cleats having top surfaces which, when the strip is mounted, provide part of the tread surface of the tread member, one said cleat being at the lateral edge of said insert strip and having a sloping surface extending downwardly and outwardly from its top surface at an angle relative to the skirt guards that is substantially larger than the corresponding angle of the other cleats of the insert strip.

19. A method of adaptation of a passenger conveyance apparatus of the type having a plurality of moving tread members having a plurality of side-most and intermediate cleats each with tread-forming top surfaces providing a travelling stairway or road, comprising the step of adapting the side-most ones of the cleats of said tread members so as to provide them at their extreme lateral edges with sloping surfaces extending downwardly and outwardly from the tread-forming top surfaces, and mounting said sloping surfaces for being slopingly opposed to skirt guards of the apparatus during use thereof at an angle relative to the skirt guards that is substantially larger than the corresponding angle of the intermediate cleats.

20. Passenger conveyance apparatus selected form escalators and traveling roads, having moving tread members and stationary skirt guards adjacent thereto, each of said tread members having intermediate cleats and side-most cleats having respectively at their lateral edges, said side-most cleats having sloping surfaces providing, in conjunction with the opposed skirt guards, spaces each of dimensions to constitute means such that a passenger's shoe contacting the skirt guard and entering the space is not pulled downwardly when the skirt guard moves in a relative direction into said spaces, and said sloping surfaces being at an angle relative to adjacent respective skirt guards that is larger than the corresponding angle of the intermediate cleats.

21. A member providing a tread surface for a passenger conveyance apparatus, which member is one of an escalator step and a pallet of a travelling road, said tread surface having opposite lateral edges which in use of the member are closely spaced from skirt guards of the apparatus, and said member at at least one of said lateral edges having an upper surface region which is stepped in the direction along the lateral edge, said stepped upper surface region comprising at least one lower surface and at least one higher surface adjacent to said lower surface in said direction and shorter than said lower surface in said direction.

22. A member according to claim 21 wherein said higher surface is less than one-third the length of said lower surface in said direction.

23. A member according to claim 21 wherein said upper surface has a length in said direction in the range 4 to 7 mm.

24. A member according to claim 21 wherein said lower surface has a length in said direction in the range 30 to 110 mm.

25. A member according to claim 21 wherein the maximum height of said higher surface above said lower surface is in the range of 1.5 to 5 mm.

26. A member according to claim 21 wherein said higher surface is at the same level as the general level of the adjacent region of the tread surface.

27. A member according to claim 21 wherein said lower surface is an outwardly and downwardly sloping surface.

28. A member according to claim 21 wherein said stepped upper surface region comprises a plurality of said higher surfaces alternating in said direction with a plurality of said lower surfaces.

29. Passenger conveyance apparatus according to claim 21 wherein said skirt guards have projections extending parallel to the direction of travel of the tread members in said upper run and overhanging said sloping surface.

30. Passenger conveyance apparatus according to claim 29 wherein said skirt guards have low-friction coatings adjacent said tread members in the upper arm.

31. Passenger conveyance apparatus having a plurality of moving tread members, means for moving said tread members in a continuous path having upper and lower runs and a pair of opposed skirt guards arranged adjacent said upper run so that the tread members move between them, each said tread member having a tread surface having opposite lateral edges which in said upper run are respectively adjacent said skirt guards, there being at each said lateral edge of the tread member an upper surface region which is stepped in the direction along the lateral edge, said stepped upper surface region comprising at least one lower surface and at least one higher surface adjacent to said lower surface in said direction and shorter than said lower surface in said direction.

32. Passenger conveyance apparatus according to claim 31 wherein said skirt guards having projections extending parallel to the direction of travel of the tread members in said upper run and overhanging said sloping surface.

33. Passenger conveyance according to claim 32 wherein said skirt guards have low-friction coatings adjacent said tread members in the upper run.

34. In passenger conveyance apparatus having a plurality of moving tread members which are moved in a continuous path to provide a travelling stairway or road and stationary skirt guards adjacent the moving members where passengers stand on them, the improvement comprising narrow upper surface regions of said tread members adjacent said skirt guards and of alternating height in the direction parallel to the skirt guards, each said upper surface region having in said direction at least one relatively short higher surface adjoining a relatively long lower surface.

35. An insert strip for a tread member of a passenger conveyance apparatus selected from escalators and travelling roads, said insert strip having at least two upstanding cleats and a base portion connecting said cleats, said cleats having top surfaces which, when the strip is mounted, provide part of the tread surface of the tread member, one said cleat being at the lateral edge of said insert strip and having an upper surface region which is stepped in the direction along the lateral edge, said stepped upper surface region comprising at least one lower surface and at least one higher surface adjacent to said lower surface in said direction and shorter than said lower surface in said direction.

36. Passenger conveyance apparatus providing a tread surface, said tread surface having opposite lateral edges which are closely spaced from skirt guards of the apparatus, said tread surface having two outside upstanding cleats forming said lateral edges and a plurality of upstanding intermediate cleats extending in the direction along the lateral edges, said cleats having side sloping surfaces extending downwardly from the top surface thereof, and the side sloping surface formed on the outside of each of said outside cleats at said lateral edges has a larger sloping angle relative to said skirt guard than the corresponding angle of the sloping surfaces of the intermediate cleats.

37. Passenger conveyance apparatus providing a tread surface, said tread surface having opposite lateral edges which are closely spaced from adjacent skirt guards of the apparatus, and each of said lateral edges having a plurality of sloping surfaces spaced along the lateral edge and each sloping surface slopes downwardly and outwardly.

* * * * *